US007575051B2

(12) United States Patent
Stoesz et al.

(10) Patent No.: US 7,575,051 B2
(45) Date of Patent: Aug. 18, 2009

(54) DOWNHOLE VIBRATORY TOOL

(75) Inventors: Carl W. Stoesz, Houston, TX (US); Rustom Mody, Bellaire, TX (US); Mohan Soni, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 222 days.

(21) Appl. No.: 11/111,661

(22) Filed: Apr. 21, 2005

(65) Prior Publication Data

US 2006/0237187 A1 Oct. 26, 2006

(51) Int. Cl.
*E21B 28/00* (2006.01)
*E21B 31/00* (2006.01)

(52) U.S. Cl. ..... 166/177.6; 166/98; 166/319

(58) Field of Classification Search ..... 166/301, 166/98, 178, 386, 373, 177.6, 320, 324, 329, 166/319; 294/68.22, 68.25; 73/864.63, 864.65, 73/864.66; 175/296
See application file for complete search history.

(56) References Cited

U.S. PATENT DOCUMENTS 1,883,071 A * 10/1932 Stone ..... 166/194
2,670,927 A * 3/1954 Edwards ..... 166/301
2,894,724 A * 7/1959 Andrew ..... 173/202
4,236,580 A 12/1980 Bodine
4,280,557 A 7/1981 Bodine
4,299,279 A 11/1981 Bodine
4,361,195 A * 11/1982 Evans ..... 175/297
4,384,625 A 5/1983 Roper et al.
4,566,546 A 1/1986 Evans
4,574,888 A 3/1986 Vogen
4,576,229 A 3/1986 Brown
4,667,742 A 5/1987 Bodine
4,673,037 A 6/1987 Bodine
5,234,056 A 8/1993 Bodine et al.
5,375,671 A 12/1994 Horvei
5,503,228 A * 4/1996 Anderson ..... 166/301
6,009,948 A 1/2000 Flanders et al.
6,062,324 A 5/2000 Hipp
6,164,393 A 12/2000 Bakke
6,182,775 B1 2/2001 Hipp
6,206,101 B1 3/2001 Bakke (Continued)

OTHER PUBLICATIONS

Stoesz, Carl W., et al., "Low-Frequency Downhole Vibration Technology applied to Fishing Operations", SPE 63129, Oct. 2000, 1-7.

(Continued)

*Primary Examiner*—Jennifer H Gay
*Assistant Examiner*—Robert E Fuller
(74) *Attorney, Agent, or Firm*—Steve Rosenblatt

(57) ABSTRACT

A vibratory tool for downhole use is capable of letting a wireline or other tools pass a passage therethrough that can be subsequently closed by landing a plug on a seat. The dump valve is disposed annularly about the central passage so that cycling the tool does not cause it to be slammed against a seat. Since only a plug is delivered to a passage the functioning parts already in the housing are made stronger to improve reliability. Additional power is delivered per stroke from modular stacked piston units. The tool can be run in a manner where the high amplitude low frequency oscillating forces are delivered to the stuck fish without impacts of the pistons on the housing.

26 Claims, 4 Drawing Sheets

U.S. PATENT DOCUMENTS

| | | | | |
|---|---|---|---|---|
| 6,412,560 | B1 | 7/2002 | Bernat | |
| 6,474,421 | B1 | 11/2002 | Stoesz | |
| 6,502,638 | B1 | 1/2003 | Stoesz | |
| 6,550,536 | B2 | 4/2003 | Bernat | |
| 6,571,870 | B2 | 6/2003 | Zheng et al. | |
| 6,666,273 | B2 * | 12/2003 | Laurel | 166/382 |
| 6,691,778 | B2 | 2/2004 | Cole et al. | |
| 6,712,134 | B2 | 3/2004 | Stoesz | |
| 6,725,923 | B1 | 4/2004 | Ivannikov et al. | |
| 6,866,104 | B2 * | 3/2005 | Stoesz et al. | 173/1 |
| 2002/0148606 | A1 | 10/2002 | Zheng et al. | |
| 2003/0150609 | A1 * | 8/2003 | Stoesz | 166/178 |
| 2004/0045716 | A1 * | 3/2004 | Bakke | 166/301 |
| 2006/0243447 | A1 * | 11/2006 | McElroy et al. | 166/301 |

OTHER PUBLICATIONS

Joppe, L.C., "Using High-Frequency Downhole Vibration Technology to Enhance Through-Tubing Fishing and Workover Operations", SPE 99415, Apr. 2006, 1-4.

Gonzalez, Ozzie, et al., "The Extraction of Mud-Stuck Tubulars Using Vibratory Resonant Techniques", SPE 109530, Nov. 2007, 1-8.

* cited by examiner

DOWNHOLE VIBRATORY TOOL

FIELD OF THE INVENTION

The field of this invention is generally downhole vibratory tools and more specifically those tools that selectively allow passage therethrough for other tools.

BACKGROUND OF THE INVENTION

Vibratory tools are used to dislodge a stuck object known as a fish from a downhole location. They have other applications such as allowing a pulling force to be transmitted from the surface to a fish stuck in a deviated wellbore. In that application the vibratory devices can be placed in the deviation such that their presence helps transmit forces to the fish that would have otherwise been resisted by the deviated wellbore through which the string extended to reach the fish. An illustration of such as application is U.S. Pat. No. 6,502,638.

Vibratory tools known in the art have operated on a similar principle. An overpull is applied to the string supporting the tool and pressure is applied within the string. A piston then travels against the bias of a spring, in effect stretching the string while compressing the spring. At some point of travel, the force applied by the spring that acts on a valve member becomes higher than the pressure applied from above to that valve member. When this happens, there is relative movement that takes the valve member off a seat. The pressure that had been keeping the valve member on the seat up to that point is suddenly relieved as the valve member is biased off the seat by the rising spring force due to compression of the spring. Once the valve member is off the seat, the pressure acting on the piston that drove the mandrel down against the spring in the first place is suddenly relieved. Flow through the tool causes a sudden drop in the applied pressure causing the piston to snap back under the spring force and re-close the valve. At that point the cycle repeats. There are variations on this basic concept. Some designs employ a piston or opposed pistons that drive the mandrel in opposed directions.

There are other common features of known designs that limit their utility. Most earlier designs did not have a capability to have a central passageway clear so that a wireline could be run through the tool to determine conditions in the vicinity of the fish. Using those designs, the vibratory tool had to be removed to run a wireline or other tools down to the fish. Most all of these designs had the dump valve that relieved pressure located in the center of the tool preventing a clear run through the tool for a wireline or other tools. A few examples of such designs are U.S. Pat. Nos. 6,062,324 and 6,206,101.

More recently a drop in dart that incorporates the working components of the vibratory tool has been developed as shown in U.S. Pat. No. 6,866,104. This patent offered a solution to the need to have wireline access through the tool body and the dart could be retrieved after the vibration operation that commenced with the landing of the dart and application of pressure. While this design allowed for wireline access through the tool it also included additional compromises unique to the design of a dart that landed and sealed around a seat downhole. The main area of compromise was that the components of the vibratory tool had to be made to fit in the dart and the dart was limited in outside diameter so that it could fit into the receptacle in the tool body. Doing this required miniaturization of the vibratory tool key components which limited the power delivery of the generated vibrations from the tool. The use of smaller components also increased the effects of fatigue on the moving parts of the vibratory tool and there were also many components to the dart assembly making it fairly costly to build and maintain.

Other issues that affected reliable operation in the previous designs included a dump valve assembly that was pounded against a seat with each cycle resulting in rapid wear and potential loss of sealing contact. Another problem in the past had been the limited power delivery from the driving piston since its area was limited by the maximum available inside diameter in the tool housing. Many applications simply needed a higher power delivery to get the fish released.

A few other examples of known designs for vibratory tools are U.S. Pat. Nos. 6,474,421; 6,182,775; 6,164,393; 5,875,842 and 5,375,671.

What is needed and is addressed by the tool described below is a collection of features that solve the issues with prior design and lead to a more economical and reliable design. The dump valve is reconfigured into an annular shape to keep the middle of the tool free and clear. This allows a central passage to exist to permit a wireline operation through the tool when the tool is not set up to be in vibratory mode. The tool can be simply put in vibratory mode by dropping a removable plug onto a seat. The dump valve opens and closes without getting slammed against a seat. The mandrel is powered by stacked pistons in the tool body to magnify the delivered power from the vibratory tool. Since the essential parts of the vibratory tool are in the housing and only the delivery of the plug is required to initiate operations, the remaining components can be designed to be more beefy so as to run longer and more reliably as compared to the prior design where the key movable components were delivered into the tool housing on a dart. The tool can be configured so that the pistons can travel their entire stroke without being banged against travel stops. The tool has the capability to tolerate continued downward mandrel movement to dissipate its momentum even after the dump valve opens. The components are then configured to apply power to the mandrel for a down cycle when the dump valve closes close to the point where the pistons reach their upward travel limit. In this way a longer power stroke is achieved in an effort to free the fish. The tool can be run to apply up oscillating forces with or without impacts depending on how the tool is operated by rig personnel. These and other advantages of the present invention and its scope will become more apparent to those skilled in the art from a review of the description of the preferred embodiment, the drawings and the claims appended below.

SUMMARY OF THE INVENTION

A vibratory tool for downhole use is capable of letting a wireline or other tools pass a passage therethrough that can be subsequently closed by landing a plug on a seat. The dump valve is disposed annularly about the central passage so that cycling the tool does not cause it to be slammed against a seat. Since only a plug is delivered to a passage the functioning parts already in the housing are made stronger to improve reliability. Additional power is delivered per stroke from modular stacked piston units. The tool can be run in a manner where the high amplitude low frequency oscillating forces are delivered to the stuck fish without impacts of the pistons on the housing.

DETAILED DESCRIPTION OF THE PREFERRED EMBODIMENT

Figure 1:
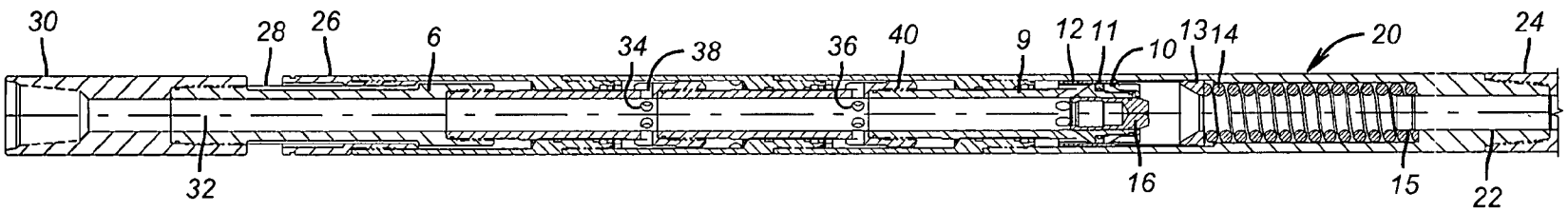
FIG. 1 is a section view of the tool with the plug in place and ready to vibrate.
Figure 2:
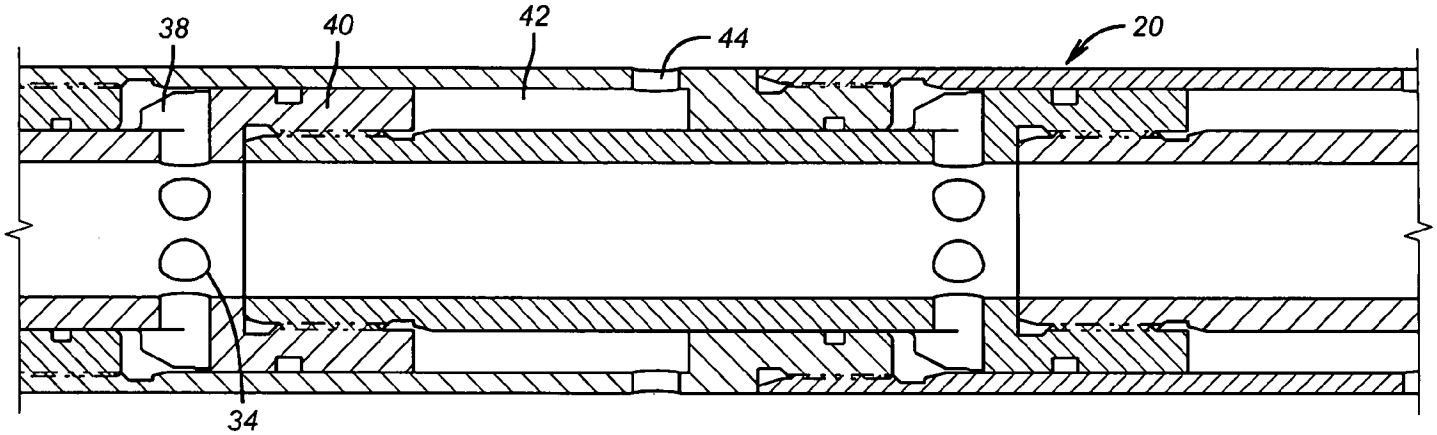
FIG. 2 is a section view of the modular piston stack that can be used in the tool.

The tool has an outer body 20 with a lower end 22 that is attached to a stuck object or fish 24. The outer body 20 has an upper end 26. Within the outer body 20 and extending uphole from upper end 26 is the mandrel 28. Mandrel 28 is connected to the surface through a string 30. Mandrel 28 has a passage 32 that is in fluid communication with the passage in the string 30 so that pressure can be delivered from the surface to lateral ports such as 34 or 36. Ports 34 and 36 are at different elevations. Although only two rows of such ports are illustrated in the preferred embodiment, the construction of the tool is preferably modular so that different numbers of rows of ports can be used. A row of ports such as 34 lead to an annular space 38 with which there is communication to a piston 40 that is attached to the mandrel 28. Pressure in space 38 pushed down piston 40 and with it mandrel 28 at the same time displacing fluid from chamber 42 through opening 44. FIG. 2 shows that this type of piston arrangement is modular allowing as many or as few pistons such as 40 to be stacked. More pistons such as 40 connected to the mandrel 28 mean more force imparted in a downward direction on the string 30 while at the same time creating an opposite reaction force on the outer body 20 that is attached to the fish 24. It should be noted that space 38 and chamber 42 are created between mandrel 28 and outer body 20. Chamber 42 sees downhole pressures through opening 44. Stacking pistons 40 in effect increases the area of total pistons exposed to the applied pressure thus increasing the delivered power of the tool to considerably more by orders of magnitude than had been available in prior art tools.

Figure 3:
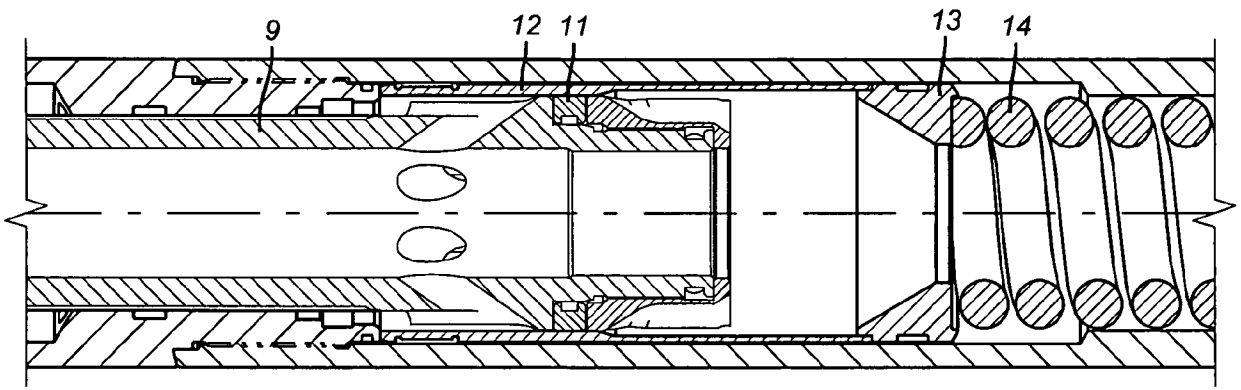
FIG. 3 is a section view of the lower end of the tool without the plug in position.
Figure 4:
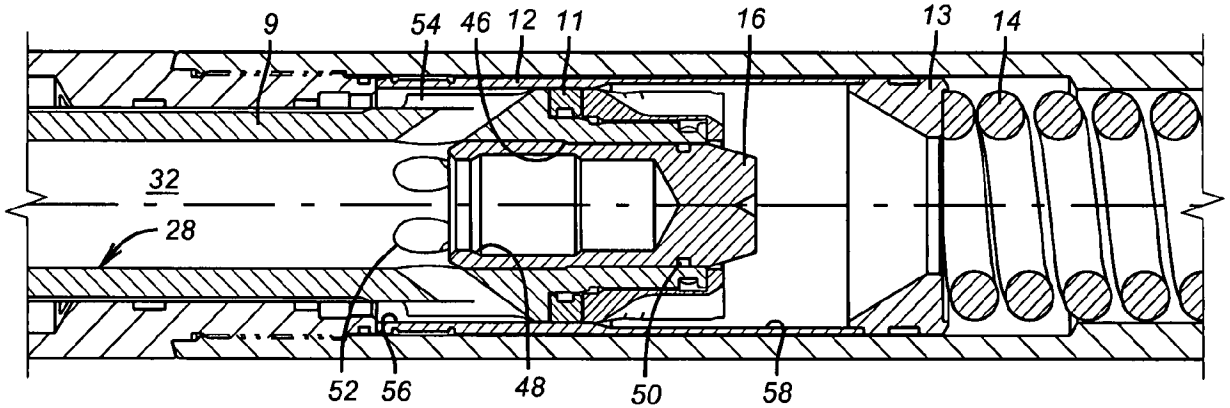
FIG. 4 is the view of FIG. 3 with the plug seated and pressure being applied.
Figure 5:
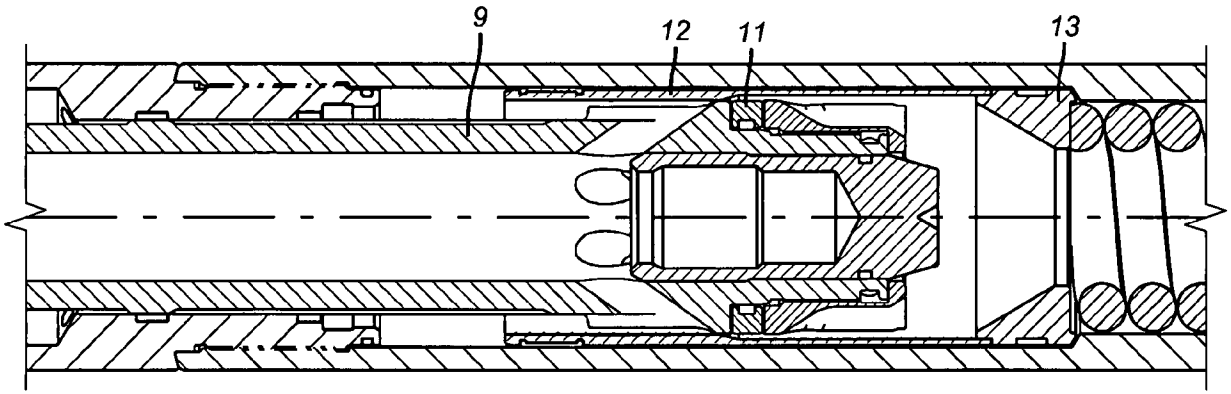
FIG. 5 is the view of FIG. 4 just before the dump valve opens.
Figure 6:
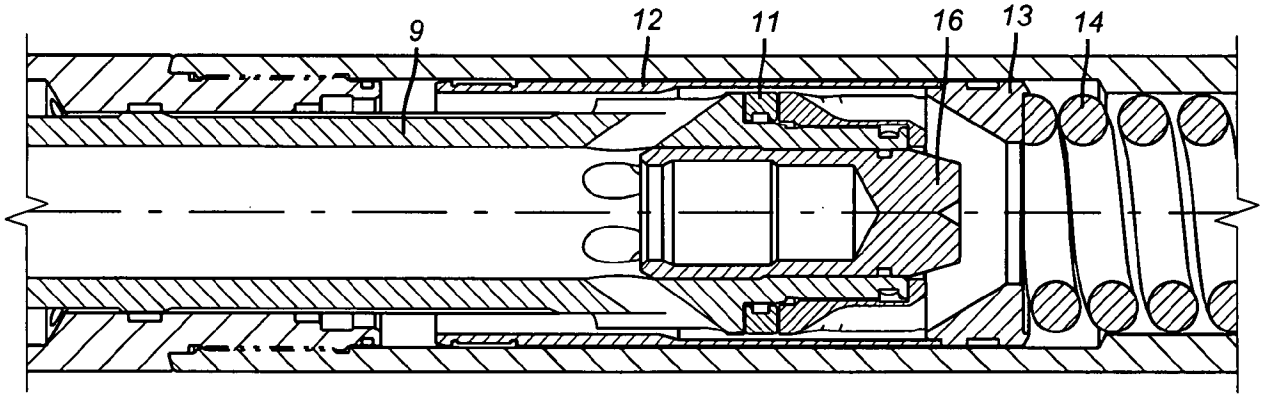
FIG. 6 is the view of FIG. 5 as the dump valve trips open.

Referring now to FIG. 4, the mandrel 28 has a lower end 9 that marks the end of passage 32 and a nearby shoulder 46. A drop in plug 16 is shown landed on shoulder 46 to close off passage 32. Those skilled in the art will appreciate that before plug 16 is dropped the passage 32 is open, as shown in FIG. 3, so that a wireline or other tool can be run through passage 32 and into the stuck fish or further down to collect any required data that may be helpful in determining the progress of the operation trying to get the fish unstuck or for any other reasons. The plug 16 is preferably retrievable and for that purpose has a fishing neck 48 so that it can be captured and returned to the surface with known tools. Plug 16 also has a seal 50 to help close off passage 32 and build pressure in it. Lower end 9 features openings 52 that lead into chamber 54. Dump valve 12 is shown closing off chamber 54 so that application of pressure to passage 32 will build pressure on piston(s) 40 to move the mandrel 28 downwardly. It should be noted that valve 12 is cylindrically shaped with a seal ring 11 initially riding on surface 56 to hold pressure in chamber 54 as the movement of the mandrel 28 stretches out string 30 that is connected to it. At some point the ring seal 11 moves off of surface 56 to surface 58 that represents an increase in inside diameter and as a result a loss of sealing contact that had previously closed off passage 32. For a time the pressure in passage 32 drives the valve 12 in tandem with the mandrel 28 due to applied pressure in chamber 54 from ports 52. The movement of valve 12 is against the bias of spring 14 bearing on spring stop 13. At some point of pressure buildup in passage 32 and tandem movement of mandrel 28 and valve 12 the force of spring 14 on stop 13 exceeds the downward force on valve 12 from pressure in passage 32. This results in the valve 12 being moved uphole with respect to the mandrel 28 to relieve the pressure built up in the passage 32. This happens due to ring seal 11 now being placed in juxtaposition with surface 58 of valve 12, breaking the seal, as shown in FIG. 5. The mandrel 28 continues to move downhole due to momentum from the extension force applied from the pressure with the passage 32 closed off at the bottom and piston(s) 40 forcing the mandrel 28 down. However, the valve 12 in the open position and the pressure in passage 32 dissipated the momentum of mandrel 28 carrying it further downhole quickly dissipates as it reaches its lowest position shown in FIG. 6.

Figure 7:
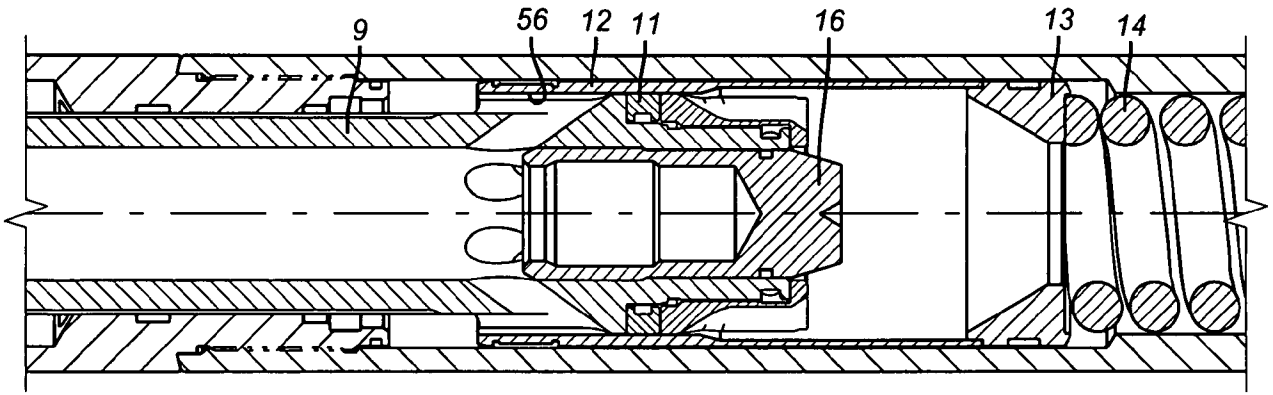
FIG. 7 is the view of FIG. 6 after sufficient uphole movement of the mandrel to close the dump valve again and repeat the cycle.

With the pressure dissipated in passage 32 the stretching of the string 30 that accompanied the downhole movement of the mandrel 28 now reverses as the string 30, now no longer exposed to a stretching force goes into a contraction cycle. With the fish 24 still stuck and holding the outer housing 20 in position, the mandrel 28 and the piston(s) 40 attached to it move up relative to the housing 20. At some point preferably before the piston(s) 40 slams into a radial surface in chamber 38 the seal ring 11 gets back into sealing contact with surface 56 of valve 12 closing off passage 32 again to allow pressure buildup and to reverse the direction of movement of mandrel 28 to allow the next cycle to begin, as shown in FIG. 7. It should be noted that the tool can be operated so that there are jarring blows delivered in every cycle or by avoiding such jarring blows. The factor that controls this is the amount of surface overpull applied to string 30 before and during when passage 32 is pressurized.

The basic operation of the tool having been reviewed, the features of the tool of the present invention can now be explored in greater detail. One such feature is the ability to stack pistons 40 to increase the available piston area in a confined downhole space so as to increase the power of the pressure spike that is applied to the fish 24. The impacting of pistons 40 on the housing 20 is optional and depends of the applied overpull to string 30. The cycling continues until applied pressure is turned off, the overpull force is removed from the surface or by the fish 24 becoming unstuck. It should be noted that without plug 16 in position, the tool can't cycle but wireline and other operations are possible through passage 32. The tool is activated by dropping a simple and cheap plug 16 into passage 32 to seal its lower end. The design of the valve 12 as an annular ring gets it out of the center of the tool to allow the wireline access feature through passage 32 before the plug 16 is dropped. It further allows the opening and closing of the valve 12 to occur without slamming any part of the valve against a seat, as in some prior designs. Instead, the ring seal 11 simply slides between surfaces 56 and 58 respectively to close and open the valve. The configuration of the valve 12 and the spring 14 about the central bore of the tool allows those components to be designed to better perform in a cyclical loading environment without fatigue or failure. It also takes away the need, as in the prior art to put all the workings of the tool in a dart that is seated in the tool body after a wireline operation below the tool body. Instead, the components of the tool are delivered within the body and still are configured to leave a passage open for wireline or other activity through the passage 32 before the plug 16 is dropped into position. This means that the components delivered with the tool initially can be bigger than they could have been as part of a dart and will give longer trouble free service. It also means that the plug 16 is simple and cheap because it has no moving parts. Additionally, the tool can be made to operate with fewer moving parts than the previous design that involved dropping the critical tool components as part of the dart assembly.

The design of valve 12 eliminates significant cyclical impacts on opening and closing due to the cylindrical shape and the seal ring 11 simply moving into alignment and misalignment with the surface that surrounds it. The use of a cylindrically shaped valve 12 allows for the spring 14 to be more beefy thus reducing the stresses on it and extending its life.

The modular design that allows selection of the number of pistons allows for a tool design to be matched to the power required for the particular work string, or the surface equipment available or the anticipated downhole conditions with the stuck fish. Presenting the valve 12 outside the mandrel 28 and the piston(s) 40 opens the center and allows the use of the simple plug 16. Wear on the valve is eliminated by avoiding banging valve components on a valve seat. Special materials can also be used for seal ring 11 to increase resistance to wear. The layout of the components allows the mandrel 28 to continue moving downhole after valve 12 opens. The result is that forces created in the modular piston 40 assembly stay in phase with the oscillating string 30 or the fish 24. This is accomplished by engaging the power stroke near the upper end of piston movement, after valve 12 opens, and before valve 12 is allowed to close again. In that manner if the momentum from the string 30 allows for a longer stroke the tool can accommodate that by not engaging the power stroke until the pistons are at or near their maximum uphole travel. On the other hand the tool can also be operated to have impacts on each cycle with the pistons 40 against the housing 20. These impacts can be on the up or down stroke and can be induced during operation by varying the overpull amount. The tool can operate without impact of the pistons 40 and can still be effective in releasing a fish 24. The tool may also be used in stimulation or fishing operations. It provides large amplitude vibrations in a tubing string. It relies on a single valve for operation.

The tool can also have a rotational lock between the mandrel 28 and the housing 20 for the purposes of torque transmission.

It is to be understood that this disclosure is merely illustrative of the presently preferred embodiments of the invention and that no limitations are intended other than as described in the appended claims.

We claim:

1. A vibratory tool for downhole use, comprising:

a housing having a longitudinal first passage therethrough;

a mandrel movably mounted to said housing and having a second passage substantially aligned with said first passage;

a valve mounted substantially outside aligned portions of said passages for selectively regulating the direction of relative movement between said mandrel and said housing;

said passages provide access for passing other tools through the tool while disabling said tool from operating when said access is available.

2. The tool of claim 1, wherein:

said valve circumscribes said mandrel.

3. The tool of claim 1, wherein:

said valve comprises a member that moves between a closed and an open position without said member receiving significant impact forces.

4. The tool of claim 3, wherein:

said sealing member is mounted to said mandrel.

5. A vibratory tool for downhole use, comprising:

a housing having a longitudinal first passage therethrough;

a mandrel movably mounted to said housing and having a second passage substantially aligned with said first passage;

a valve mounted substantially outside aligned portions of said passages for selectively regulating the direction of relative movement between said mandrel and said housing;

said tool further comprises a plug insertable in said aligned passages to selectively enable the tool to operate.

6. The tool of claim 5, wherein:

said plug has no moving parts.

7. A vibratory tool for downhole use, comprising:

a housing having a longitudinal first passage therethrough;

a mandrel movably mounted to said housing and having a second passage substantially aligned with said first passage;

a valve mounted outside aligned portions of said passages for selectively regulating the continuous and cyclical direction of relative movement between said mandrel and said housing that continues as long as input to said mandrel and housing is not changed;

said mandrel comprises a plurality of pistons whose piston area is additive in defining a driving force for moving said mandrel in one direction.

8. The tool of claim 7, wherein:

said pistons are connected to said mandrel and disposed in an annular space between said mandrel and said housing;

said passage in said mandrel comprising a plurality lateral outlets into said annular space to transmit pressure in said mandrel passage to drive said pistons.

9. The tool of claim 7, wherein:

said housing and said mandrel are modular structures to facilitate assembly of the desired number of pistons into the tool.

10. The tool of claim 7, wherein:

said pistons are selectively movable in tandem in opposed directions without impacting said housing that surrounds them.

11. The tool of claim 7, wherein:

said mandrel continues to move, from an original position, in the direction powered by said pistons after said valve opens, and said pistons thereafter remain disabled from powering said mandrel for another cycle until said mandrel is returned substantially to its original position so as to maximize the stroke length of mandrel movement.

12. The tool of claim 11, wherein:

said valve closes as said pistons return to said original position.

13. A vibratory tool for downhole use, comprising:

a housing having a longitudinal first passage therethrough;

a mandrel movably mounted to said housing and having a second passage substantially aligned with said first passage;

a valve mounted substantially outside aligned portions of said passages for selectively regulating the direction of relative movement between said mandrel and said housing;

said valve circumscribes said mandrel;

said valve comprises an inner surface facing said mandrel with a larger and smaller dimension;

said mandrel comprises a seal to close said valve when said seal is in contact with said smaller dimension and to open said valve when said seal is moved to adjacent and out of contact with said larger dimension.

14. A surface controlled vibratory tool for downhole use, comprising:

a housing;

a mandrel movably mounted to said housing;

a valve for selectively regulating the direction of relative movement between said mandrel and said housing, said valve comprises a member that moves axially in a single direction with respect to said mandrel between a closed position wherein contact is made on an inner periphery of said valve member and an open position where contact is discontinued on the inner periphery of said valve member and continues movement between said open and said closed positions with continuously delivered surface pressure to said housing.

15. The tool of claim 14, further comprising:

a sealing member mounted to said mandrel.

16. The tool of claim 14, wherein:

said mandrel comprises a plurality of pistons whose piston area is additive in defining a driving force for moving said mandrel in one direction.

17. The tool of claim 16, wherein:

said pistons are selectively movable in tandem in opposed directions without impacting said housing that surrounds them.

18. The tool of claim 16, wherein:

said mandrel continues to move, from an original position, in the direction powered by said pistons after said valve opens, and said pistons thereafter remain disabled from powering said mandrel for another cycle until said mandrel is returned substantially to its original position so as to maximize the stroke length of mandrel movement.

19. A vibratory tool for downhole use, comprising:

a housing;

a mandrel movably mounted to said housing;

a valve for selectively regulating the direction of relative movement between said mandrel and said housing, said valve comprises a member that moves between a closed and an open position without said member receiving significant impact forces;

said valve comprises an inner surface facing said mandrel with a larger and smaller dimension;

said mandrel comprises a seal to close said valve when said seal is in contact with said smaller dimension and to open said valve when said seal is moved to adjacent and out of contact with said larger dimension.

20. The tool of claim 19, wherein:

said valve circumscribes said mandrel;

said housing having a longitudinal first passage therethrough;

said mandrel having a second passage substantially aligned with said first passage, said valve mounted substantially outside aligned portions of said passages.

21. A vibratory tool for downhole use, comprising:

a housing;

a mandrel movably mounted to said housing;

a valve member having an inner periphery for selectively regulating the continuous and cyclical direction of relative movement between said mandrel and said housing by virtue of establishment and removal of surface contact of said inner periphery that continues as long as input to said mandrel and housing is not changed;

said mandrel comprises a plurality of pistons whose piston area is additive in defining a driving force for moving said mandrel in one direction.

22. The tool of claim 21, wherein:

said pistons are connected to said mandrel and disposed in an annular space between said mandrel and said housing;

said passage in said mandrel comprising a plurality of lateral outlets into said annular space to transmit pressure in said mandrel passage to drive said pistons.

23. The tool of claim 21, wherein:

said housing and said mandrel are modular structures to facilitate assembly of the desired number of pistons into the tool.

24. The tool of claim 21, wherein:

said pistons are selectively movable in tandem in opposed directions without impacting said housing that surrounds them.

25. The tool of claim 21, wherein:

said mandrel continues to move, from an original position, in the direction powered by said pistons after said valve opens, and said pistons thereafter remain disabled from powering said mandrel for another cycle until said mandrel is returned substantially to its original position so as to maximize the stroke length of mandrel movement.

26. The tool of claim 25, wherein:

said valve closes as said pistons return to said original position.

* * * * *